United States Patent [19]

Yonkers

[11] Patent Number: 4,516,197

[45] Date of Patent: May 7, 1985

[54] ANTIGLARE PANEL

[76] Inventor: Edward H. Yonkers, 905 Westerfield, Wilmette, Ill. 60091

[21] Appl. No.: 639,208

[22] Filed: Aug. 9, 1984

[51] Int. Cl.[3] ..... F21V 7/00

[52] U.S. Cl. ..... 362/342; 362/147; 362/217; 362/290; 362/354

[58] Field of Search ..... 362/147, 217, 290, 342, 362/354

[56] References Cited

U.S. PATENT DOCUMENTS

| | | | |
|---|---|---|---|
| 2,837,632 | 6/1958 | Lipscomb | 362/342 |
| 3,628,007 | 12/1971 | Rosenberg | 362/342 |
| 4,222,094 | 9/1980 | Wolar | 362/342 |

*Primary Examiner*—Stephen J. Lechert, Jr.
*Attorney, Agent, or Firm*—Andrew J. Bootz

[57] ABSTRACT

An antiglare panel is formed of a series of identical inter-locked strips. Each of the strips is formed of a series of "W" shapes having two connected short legs formed at right angles to each other and two long legs extending at right angles from a respective short leg to define the "W" shape. The long legs of adjacent "W's" are formed at right angles to define a projecting right angle. The projecting right angles of one strip are positioned within the recessed right angles of an adjacent strip so that the interior surface of the short legs overlie a portion of the exterior surface of the long legs to provide contacting surfaces. Such contacting surfaces may be secured together.

In a preferred embodiment, the strips are formed of tinned steel strip, and the assembled strips are heated after assembly to a temperature above the melting point of the tin coating to provide a metal bond at all contacting surfaces.

5 Claims, 14 Drawing Figures

ANTIGLARE PANEL

The present invention relates to improvements in light diffusing and antiglare panels employed to reduce the direct glare from concentrated light sources, and particularly in business and industrial structures where high intensity uniform illumination is reguired over large areas.

BACKGROUND OF THE INVENTION

Antiglare from strong concentrated light sources is frequently handled in todays state of the art by mounting the concentrated light source to the ceiling with downward reflecting backing, with antiglare panels suspended from the ceiling below the light source. One manner of achieving the antiglare effect is by employing a refraction system of panels of transparent plastic with surfaces molded to form prisms or lenses to diffuse the light and reduce the glare. Another widely used means of achieving the antiglare effect is to construct the antiglare panels of the rectangular cells of plastic or metal of the order of $\frac{1}{2}'' \times \frac{1}{2}''$ in the horizontal plane and $\frac{1}{2}''$ in the vertical plane. The tops and bottoms of the cells are open permitting the light flux to pass freely in the vertical direction but limiting the angular light to about 45° so that a person moving under the light system would not view the concentrated light sources directly in normal activities in the illuminated area. The rectangular cell panel is more effecient than the refraction system and when constructed of metal it is more efficient than the plastic panel because the metal permits thinner cell walls. An additional advantage of the metal cell panel is that it avoid the fire hazard presented by plastic materials in the ceiling which can disintegrate under heat forming dangerous noxious gases.

The metal antiglare panels in use today generally employ "egg-crate" construction, that is, there is provided a plurality of lineal strips slotted periodically from one side to the center of the strip and interlocked at 90° with the unslotted half of the strip entering the slot of the cross-strips. Such construction is difficult to automatic mass production and entails great precision and costly production machinery, particularly in the assembly of the cross-strips.

SUMMARY OF THE INVENTION

In accordance with the present invention, there is provided an improved cellular antiglare panel. The antiglare panel of the present invention comprises a plurality of identical interlocked strips, each strip being formed of a series of "W" shapes. Each "W" shape is formed of two connected short legs formed at right angles to each and of two long legs each extending at right angles from a respective short leg to define the "W" shape. The long legs of adjacent "W" shapes in each strip are formed at right angles with each other to define a projecting right angle, and the connected short legs of each "W" shape define a recessed right angle. The exterior surface of the projecting right angles of one strip are positioned within and against the interior surface of the recessed right angles of an adjacent strip, so that the short legs of the adjacent strip overlie the long legs of the first strip providing contacting surfaces.

The contacting surfaces of adjacent strips are secured together, as by adhesive.

In a preferred embodiment, the strips are formed of tinned steel strip, and the adjacent strips are secured together by heating the assembled strips to a temperature above the melting point of the tin coating providing a metal bond of all contacting surfaces.

In accordance with another embodiment of the invention, there is provided a series of "M" shapes along one longitudinal half of the strip, and a series of "W" shapes are provided along the other longitudinal half of the strip. Each of the "M" and "W" shapes are formed as above, with connected short legs and long legs, and the adjacent strips are joined in honeycomb fashion with the projecting right angles of the "M" and "W" shapes positioned within the recessed right angles of adjacent strips.

Advantageously, the present invention lends itself to easy, low cost production and very simple low cost tooling; and the strips may be readily assembled and secured together to form the panel.

BRIEF DESCRIPTION OF THE DRAWINGS

Referring now to the drawings.

DESCRIPTION OF THE EMBODIMENT OF FIGS. 1 THROUGH 4

Figure 1:
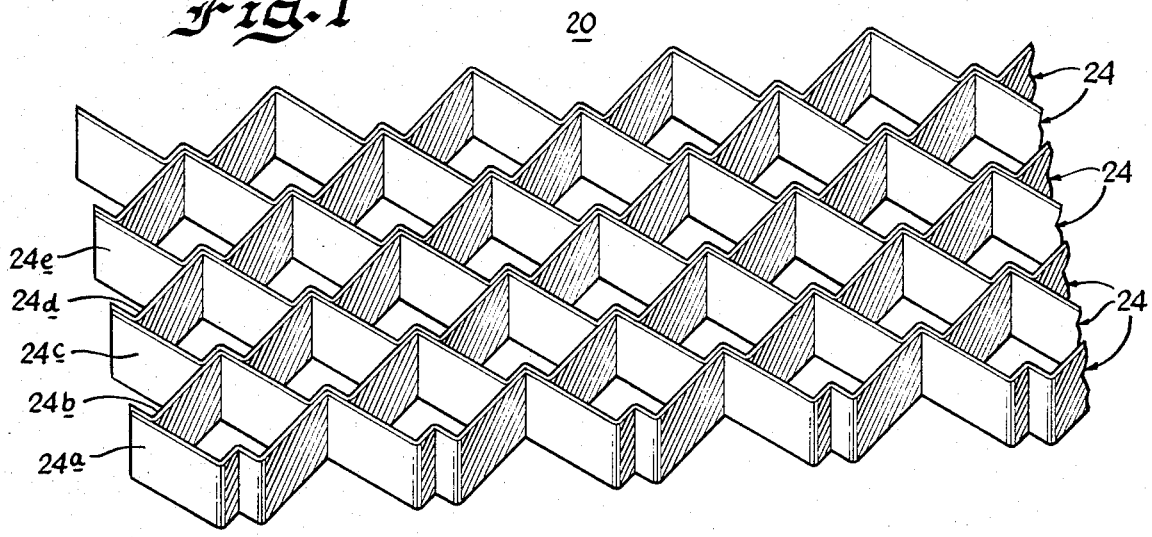
FIG. 1 is a perspective view of assembled panel strips according to the present invention.
Figure 2:
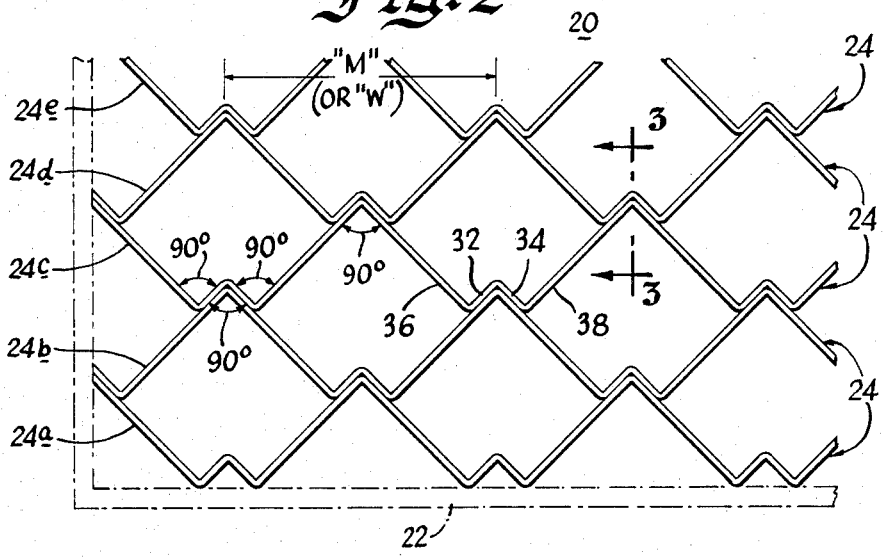
FIG. 2 is a partial plan view of the panel of FIG. 1.

Referring now to the embodiment of FIGS. 1 through 4, there is illustrated an antiglare panel, fragmentarily shown as 20, FIGS. 1 and 2, having a frame, shown in phantom as 22, FIG. 2, and a plurality of formed strips, 24*a*, 24*b*, 24*c*, 24*d*, 24*e*, etc., collectively referred to as 24. The strips 24 are identical, except that adjacent strips, e.g., 24*a* and 24*b*, are displaced relative to each other. Each of the strips 24 have been formed to define a series of "W" shapes, 30, best seen in FIG. 4.

Each of the "W" shapes is formed of two connected short legs, 32, 34 formed at right angles to each other, shown as $\alpha$, and of two long legs, 36, 38 extending at right angles from a respective short leg thereby defining the "W" shape. Long legs of adjacent "W" shapes in each strip are formed at right angles to each other to define a projecting angle $\beta$, complementary to the recessed angles $\alpha$.

The strips 20 are assembled into the panel 20 with the strip 24*a* in contact with the bottom horizontal member of the frame 22, FIG. 2. Strip 24*b* and all alternate strips start with a ½ "W" shape, so as to permit the strips to interlock exactly, forming the array of essentially rectangular cells with interlocking corners. Thus the exterior surface of the projecting right angles $\beta$ of one strip are positioned within and against the interior surface of the recessed right angles $\alpha$ of an adjacent strip, so that the short legs 32,34 of one strip overlie a portion of the long legs 36, 38 of an adjacent strip providing interlocking corners and contacting surfaces. These interlocking corners provide precisely fitting small surfaces which support one another when the strips are pressed together within the frame, creating thus, a strong cellular panel of light transmission in the vertical direction since thin strip, e.g., 0.010" strip may be used. Increased mechanical integrity is easily obtained by applying cement to the interlocking corners.

Figure 3:
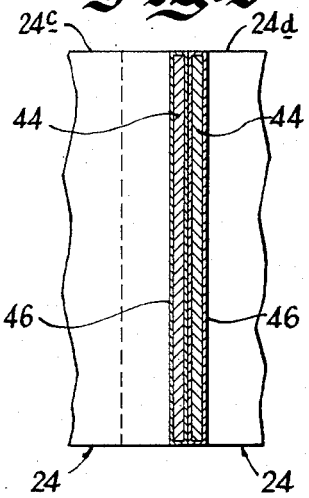
FIG. 3 is a cross-section of the panel of FIG. 1, taken through plane 3—3 of FIG. 2.
Figure 4:
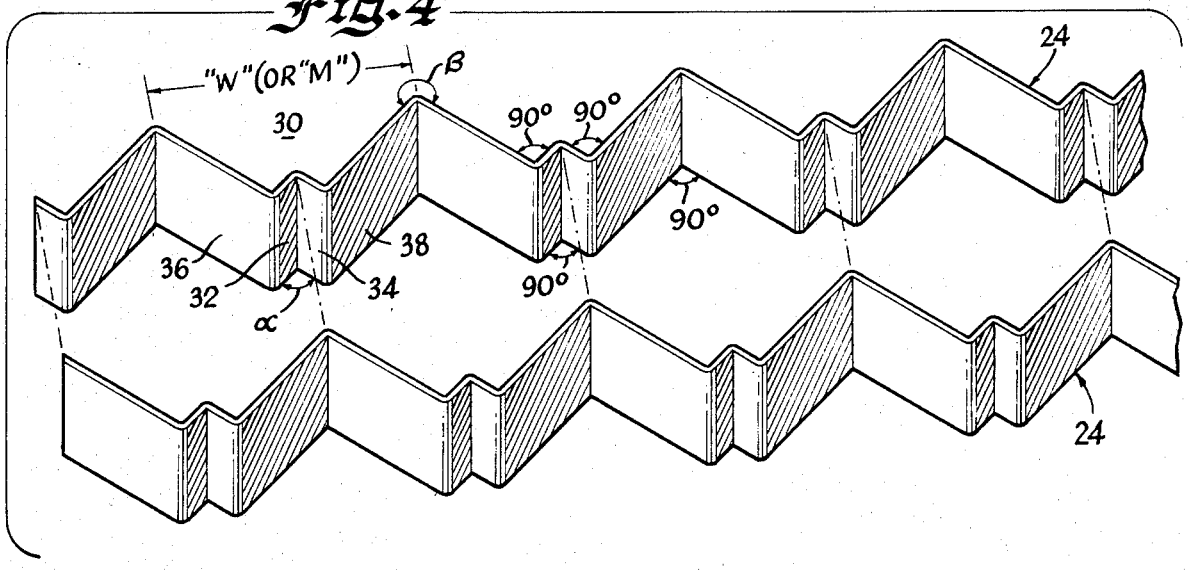
FIG. 4 is an exploded view of adjacent strips according to the embodiment of FIG. 1.
Figure 5:
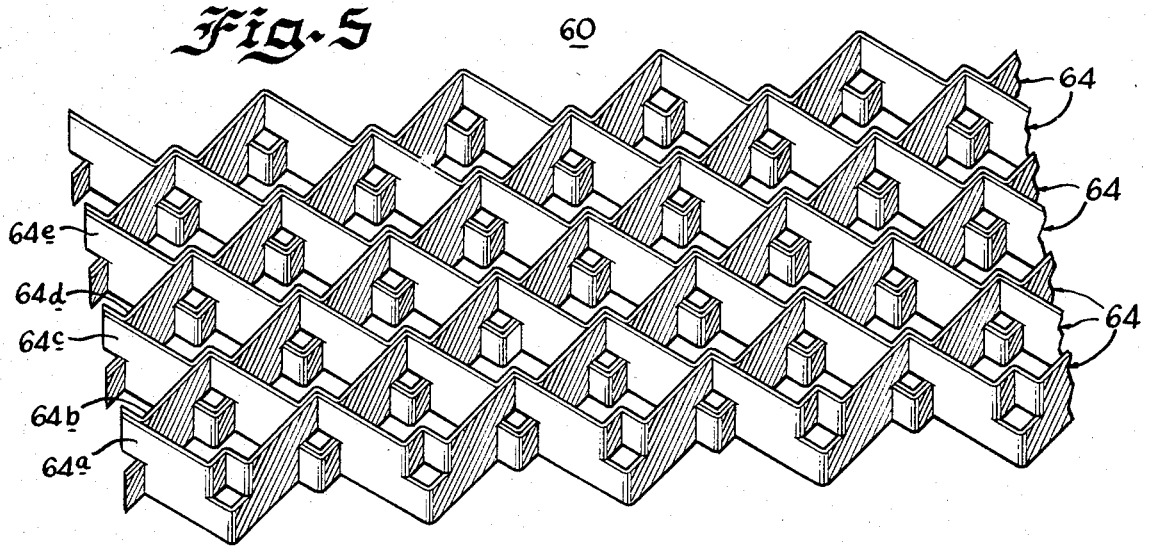
FIG. 5 is a perspective view of assembled panel strips according to another embodiment of the invention.

In the preferred illustrated embodiment of the invention the strips 24 are formed of tinned steel strip, ½" wide and 0.010" to 0.015" thick similar to the material commonly used in food containers, and including a steel core 44, FIG. 3, with tin coating, 46. The assembled panels as shown are placed in a stainless steel box to maintain its shape under compression. The whole assemblied panel and box is then heated to a temperature above the melting point of the tin coating 46 to provide a metal bond in all the contacting surfaces at the interlocking corners throughout the panel thus providing a strong panel with the maximum features to perform the antiglare function, highly efficient with respect to light transmission in the vertical direction, and having low material and production costs and completely free of fire hazard.

It will be understood that the contacting surfaces of the strips may be secured together in other ways, such as with cement.

Referring to FIGS. 1 through 4, it is noted that the illustrated structure appears to be made up entirely of "W" shapes. However, if the strips were rotated 180°, they would appear to be made up of "M" shapes. Thus the embodiment of FIGS. 1 through 4 may be referred to as the "M or W" form.

In the illustrated embodiment, the length of the long legs 36, 38 of both the "M" and "W" are exactly four times the length of the short legs 32, 34. This ratio of 4 to 1 is specific for the illustrated design. However, the invention is not limited to this particular ration, and ratios of 3 to 1 or 5 to 1 or values in between would yield adequate structures. The specific dimensions of the embodiment represent a very practicable design for the antiglare panel purposes.

Moreover, there are obviously other uses for such panel structures, such as air flow control filter backing which requires a free flow normal to the panel.

Figure 9:
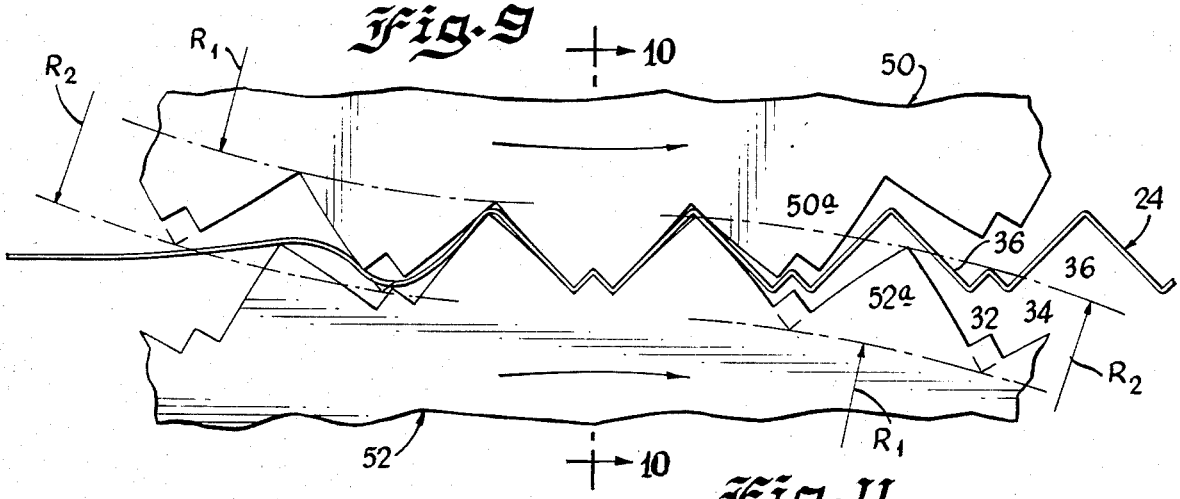
FIG. 9 is a plan view illustrating the formation of the strips of the embodiment of FIG. 1.
Figure 10:
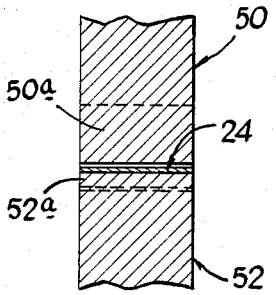
FIG. 10 is a cross-section of the forming wheels of FIG. 9, taken along plane 10—10 of FIG. 9.
Figure 11:
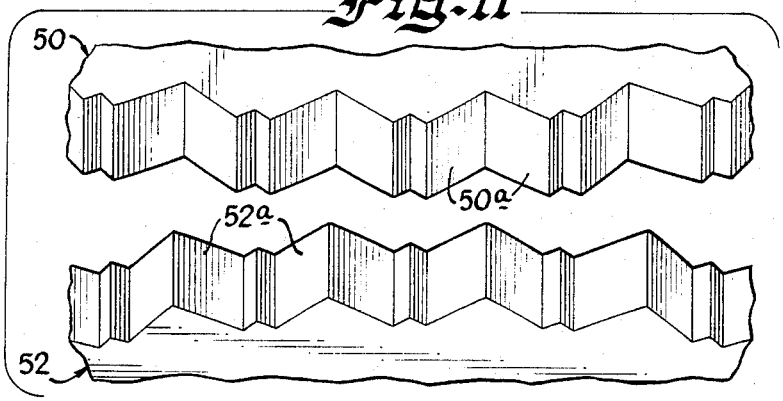
FIG. 11 is an exploded perspective of the forming wheels of FIG. 9.
Figure 12:
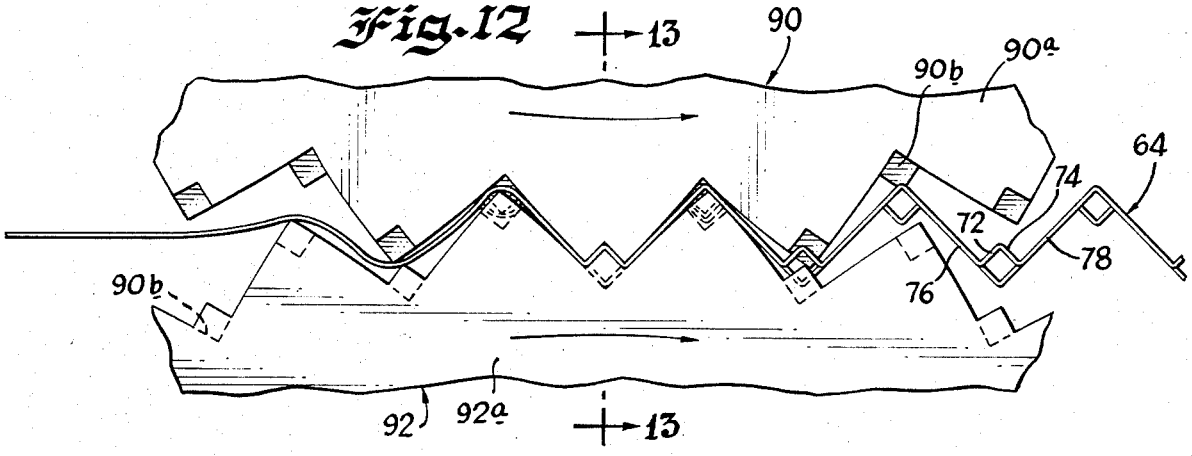
FIG. 12 is a plan view illustrating the formation of the strips of the embodiment of FIG. 5.

FIGS. 9 through 11 illustrate how the "M or W" strip of FIGS. 1 through 4 can be formed in continuous strip as long as required by passing the ½" wide strip 24 between two rotary dies, 50,52 engaged as gears with the required forms as peripheral teeth 50*a*, 52*a*. The peripheral teeth 50*a*, 52*a* interlock exactly at the tangent point of the two wheel dies 50, 52. This is possible because all bends are 90° and the surfaces between bends are planar and are at 45° to the radii of the die wheels 50, 52. One die wheel may be referred to as an "M" wheel, and the other wheel may be referred to as a "W" wheel. This is because the dies must interfit as gears; thus, the teeth on one appear as "M" and the teeth on the other appear as "W". Obviously the radius of the wheels must be selected so that a whole number of "M's" in one wheel and a whole number of "W's" will occur in one revolution of the system.

The angular section required for each form is 8° which gives 45 form elements per rotation; and the radii of the wheels have an inner radus $R_1$ of 5.85" and an effective outer radius $R_2$ of 6.33".

The repeating die elements must rotate and the design specifies that all bends shall be at 90°, so there must be a compromise in the die form by blending all the long legs as shown in FIG. 9. This permits the strips to fit the curve of the wheels but does not change the resulting stip form because the blend change is small and causes only a slight deviation from the planar surface so that this part of the strip will spring back to planar after passing through the die wheels. The 90° bends on the other hand will remain essentially at 90° after passing through the wheels because of the strain produced by the sharp corners at the 90° bends.

DESCRIPTION OF THE EMBODIMENT OF FIGS. 5 THROUGH 8

Figure 6:
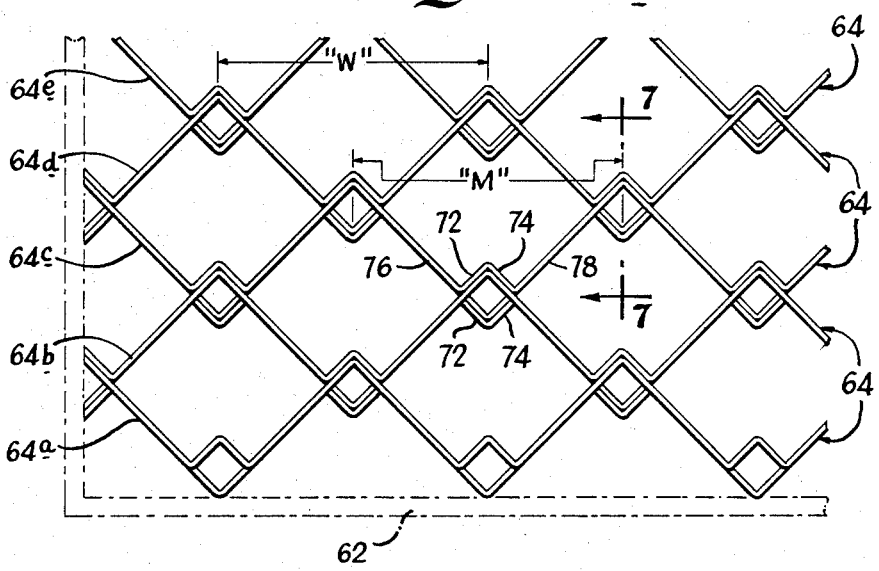
FIG. 6 is a partial plan view of the panel of FIG. 5.

Referring now to the embodiment of FIGS. 5 through 8, there is illustrated a modified form of the invention that employs the same "W" formed strip as in the embodiment of FIGS. 1 through 4 on the upper half of the strip, but which also carries a "M" shape on the lower longitudinal half of the strip. More specifically, there is illustrated an antiglare panel 60, FIGS. 5 and 6, having a frame, shown in phantom as 62, FIG. 6, and a plurality of formed strips, 64*a*, 64*b*, 64*c*, 64*d*, 64*e*, etc., collectively referred to as 64. The strips 64 are identical, except that adjacent strips, e.g., 64*a* and 64*b*, are displaced relative to each other. The goemetry of the "M" shapes and of the "W" shapes are similar to that of the embodiment of FIGS. 1 through 4, except that the "M" shapes are formed along one longitudinal half of each strip 64, while the "W" shapes are formed along the other longitudingal half of the strip, as shown in FIG. 6 as to strip 64*d*. Each "M" and "W" shape is formed of two connected short legs, 72, 74, formed at right angles to each other, and of two long legs, 76, 78, extending at right angles from a respoective short leg thereby defining the "M" and "W" shapes in each longitudinal half of the strips. The "M" and "W" shapes, of course, share a common one of the long legs, 76 or 78.

Figure 7:
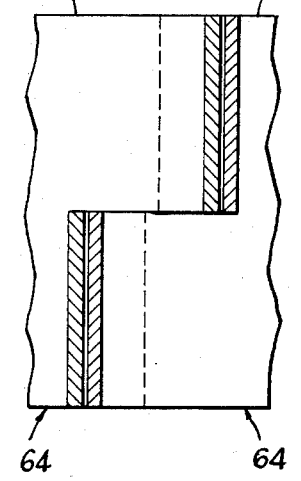
FIG. 7 is a cross-section of the panel of FIG. 5, taken through plane 7—7 of FIG. 6.
Figure 8:
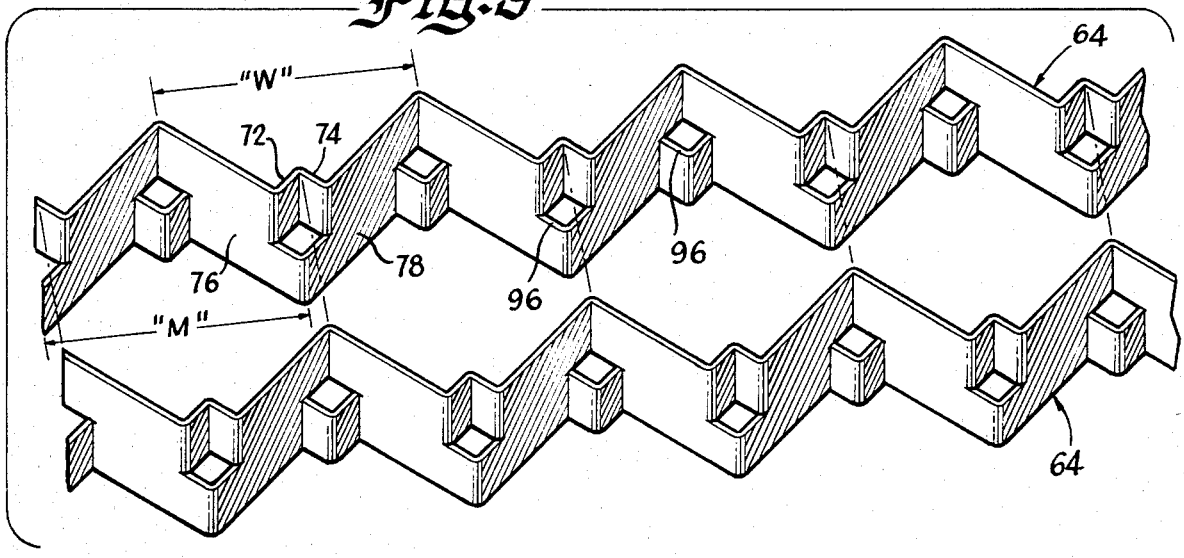
FIG. 8 is an exploded view of adjacent strips according to the embodiment of FIG. 5.

When these "MW" formed strips are assmbled in a frame, as shown in FIG. 6, both the "M" corners and the "W" corners interfit providing a double set of contacting surfaces as well as a positive vertical interlock, FIG. 7. The short legs of each "M" and "W" shape define a recessed right angle, while the adjacent long legs of each "M" and "W" define a projecting right angle, similar to the enbodiment of FIGS. 1 through 4, so that the exterior surfaces of the projecting right angles of one strip are positioned within and against the interior surfaces of the recessed right angles of an adjacent strip. Moreover, the vertical interlock occurs at the center of the stip where the "M" and "W" shapes are contiguous. Thus in this form of the invention there is both horizontal and vertical interlocking between the strips providing added mechanical strength, and gives the assembled panel adequate mechanical integrity without the use of an adhesive or solder bond on the contacting surfaces. Thus this "MW" form of the invention permits the use of aluminum and other metals which are difficult to solder-bond, and which may provide a lighter all metal panel.

Figure 13:
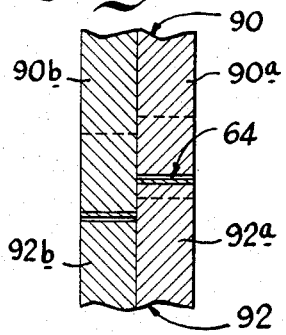
FIG. 13 is a cross-section of the forming wheels of FIG. 12, taken along plane 13—13 of FIG. 12.
Figure 14:
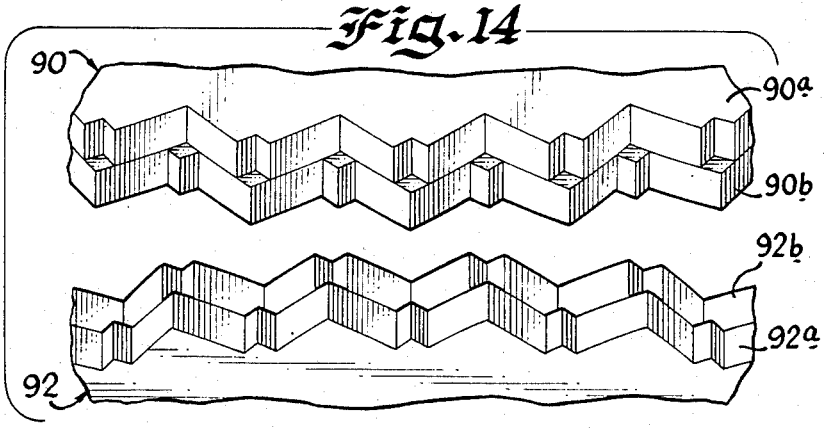
FIG. 14 is an exploded perspective of the forming wheels of FIG. 12.

In order to form the "MW" double interlocking system of FIGS. 5 through 8, there is provided four die wheels 90*a*, 90*b*, 92*a*, 92*b* of the same radial design shown in FIGS. 9 through 11. Each of the die wheels 90*a*, 90*b*, 92*a*, and 92*b*, however, are each $\frac{1}{4}''$ thick instead of $\frac{1}{2}''$ and two will have the "M" form and two will have the "W" form. The die wheels are assembled as best shown in FIGS. 13 and 14. Each of the double dies will be mechanically locked together, so that die wheels 90*a* and 90*b* function as a single die, and die wheels 92*a*, 92*b* also function as a single die wheel. There is a short lineal shear 96, FIG. 8, at the center of the strip where the opposing "M" and "W" points pass each other. Since the die edges are sharp and contiguous they act as shear blades permitting the "opposite point" forming to take place.

What is claimed as new and desired to be secured by Letters Patent of the United States is:

1. A cellular antiglare panel comprising a plurality of identical interlocked strips, each strip being formed of a series of "W" shapes having two connected short legs formed at right angles to each other defining a recessed right angle and two long legs each extending at right angles from a respective short leg to define the "W" shapes, the long legs of adjacent "W" shapes being formed at right angles with each other to define a projecting right angle, the exterior surface of the projecting right angles of one strip being positioned within and against the interior surface of the recessed right angles of an adjacent strip, so that the short legs of said adjacent strip overlie the long legs of said one strip to provide contacting surfaces.

2. A cellular antiglare panel as set forth in claim 1 and including means securing said contracting surfaces together.

3. A cellular antiglare panel as set forth in claim 1 wherein said strips are formed of tinned steel strip which have been heated after assembly to a temperature above the melting point of the tin coating to provide a metal bond at all contacting surfaces.

4. A cellular antiglare panel as set forth in claim 1 wherein said "W" shapes are formed along one longitudinal half of each strip, and a series of "M" shapes are formed along the other longitudinal half of each strip, and wherein both said "M" shapes and said "W" shapes are formed of said short and long legs defining alternates recessed right angles and projecting right angles.

5. A cellular antiglare panel conprising a plurality of interlocked strips, each strip being formed with a series of "W" shapes along one longitudinal half of said strip and a series of "M" shapes along the other longitudinal half of said strip; each of said "M" and "W" shapes having two connected short legs formed at right angles to each other and two long legs each extending at right angles from a respective short leg to define the "M" shapes, the long legs of adjacent "W" shapes being formed at right angles with each other to define a projecting right angle, the exterior surface of the projecting right angles of one strip being positioned within and against the interior surface of the recessed right angles of an adjacent strip, so that the short legs of said adjacent strip overlie the long legs of said one strip to provide contacting surfaces.

* * * * *